United States Patent [19]

Locker et al.

[11] 4,225,666

[45] Sep. 30, 1980

[54] SILVER HALIDE PRECIPITATION AND METHINE DYE SPECTRAL SENSITIZATION PROCESS AND PRODUCTS THEREOF

[75] Inventors: David J. Locker; Richard L. Daubendiek, both of Rochester, N.Y.

[73] Assignee: Eastman Kodak Company, Rochester, N.Y.

[21] Appl. No.: 8,911

[22] Filed: Feb. 2, 1979

Related U.S. Application Data

[63] Continuation-in-part of Ser. No. 881,230, Feb. 27, 1978, abandoned.

[51] Int. Cl.[2] ..... G03C 1/02; G03C 1/16

[52] U.S. Cl. ..... 430/569; 430/570; 430/581; 430/591; 430/592

[58] Field of Search ..... 96/94 R, 94 BF, 120, 96/121, 130; 430/569, 581, 591

[56] References Cited

U.S. PATENT DOCUMENTS

| | | | |
|---|---|---|---|
| 785,219 | 3/1905 | Kieser | 96/120 |
| 2,735,766 | 2/1956 | Hill | 96/121 |
| 3,628,960 | 12/1971 | Philippaerts et al. | 96/94 R |
| 3,883,355 | 5/1975 | Walworth | 96/94 R |
| 3,917,485 | 11/1975 | Morgan | 96/120 |
| 4,060,419 | 11/1977 | Gerber et al. | 96/94 BF |

OTHER PUBLICATIONS

Reinders, "Studies of Photohalide Crystals", Kolloid-Zeitschrift, vol. 9, pp. 10–14, 1911.

*Primary Examiner*—J. Travis Brown
*Attorney, Agent, or Firm*—Carl O. Thomas

[57] ABSTRACT

A method of precipitating silver halide is disclosed in which a methine spectral sensitizing dye is introduced into the reaction vessel in which precipitation of silver halide is performed after nucleation of the silver halide grains has occurred and before completion of silver halide precipitation. The silver halide grains spectrally sensitized in this manner exhibit relatively high minus blue speeds.

19 Claims, No Drawings

SILVER HALIDE PRECIPITATION AND METHINE DYE SPECTRAL SENSITIZATION PROCESS AND PRODUCTS THEREOF

CROSS-REFERENCE TO RELATED APPLICATION(S)

This is a continuation-in-part of U.S. Ser. No. 881,230, filed Feb. 27, 1978, now abandoned.

This disclosure is directed to a process of preparing spectrally sensitized silver halide grains and to products formed by the spectrally sensitized silver halide grains.

In spectrally sensitizing silver halide emulsions it is conventional practice to adsorb the spectral sensitizing dyes to the surfaces of the silver halide grains after they have been completely formed. However, there are some variant teachings in the art.

Hill U.S. Pat. No. 2,735,766, issued Feb. 21, 1956, discloses that photographic spectral sensitizing dye wandering can be eliminated or reduced by introducing a merocyanine spectral sensitizing dye during silver halide precipitation. Hill teaches to blend the spectral sensitizing dye with either the silver salt or the halide salt prior to bringing these salts together to form silver halide. Hill specifically states that the teachings do not extend to other optical sensitizing dyes, such as those of the carbocyanine class.

Philippaerts U.S. Pat. No. 3,628,960, issued Dec. 21, 1971, in discussing methine dye spectral sensitization of a blended emulsion states that the dyes can be incorporated in a separate addition or can be added as a mixture with one or more ingredients used in the formation of the different silver halide grains, during physical or chemical ripening or during another step preceding the coating of the emulsion.

In one aspect, this invention is directed to a method of preparing a spectrally sensitized radiation-sensitive silver halide emulsion comprising introducing into a reaction vessel an aqueous solution of a silver salt, an aqueous solution of a halide salt, a peptizer and a methine spectral sensitizing dye. The dye is added to the reaction vessel during the course of introducing at least one of the aqueous salt solutions. In this method the improvement comprises delaying addition of the spectral sensitizing dye until silver halide grain nuclei are present within the reaction vessel.

In another aspect, the invention relates to the products of the process described above.

This invention offers one or more of the following advantages: (1) improved photographic speeds, particularly minus blue speeds; (2) better shelf like stability; (3) substantial elimination of dye desorption and staining; (4) altered dye absorption characteristics; and/or (5) control or modification of the silver halide grain crystal habit.

This method is generally applicable to any conventional method of forming radiation-sensitive silver halide grains in which an aqueous solution of a silver salt and an aqueous solution of a halide salt are brought into association to form radiation-sensitive silver halide grains as a reaction product. This method is particularly applicable to the spectral sensitization of radiation-sensitive silver chloride, silver iodide, silver bromide, silver bromoiodide, silver chlorobromide, silver chloroiodide and silver chlorobromoiodide crystals. It is generally preferred that the silver haloiodide crystals contain less than about 10 mole percent iodide, based on total halide, although in specialized applications high iodide silver haloiodides can be advantageous.

The method of this invention for preparing and concurrently spectrally sensitizing silver halide emulsions can be practiced by modifying, in the manner described below, conventional procedures for single jet and double jet preparation of silver halide emulsions. In single jet precipitations an aqueous solution of a silver salt, such as silver nitrate, is run into a reaction vessel containing an aqueous solution of a halide salt, such as an alkali e.g. sodium or potassium halide, and a peptizer. In double jet precipitations the aqueous silver salt and the aqueous halide salt are concurrently and separately introduced into the reaction vessel. Typically at least a portion of the peptizer is initially present in the reaction vessel and additional peptizer is commonly introduced into the reaction vessel during the run. An illustrative conventional single jet silver halide precipitation technique is that disclosed by Trivelli and and Smith, "The Photographic Journal", No. LXXIX, May 1939, pp. 330–338. Nietz and Russell U.S. Pat. No. 2,222,264, issued Nov. 19, 1940, is illustrative of a double jet silver halide emulsion precipitation process. Single and double jet silver halide emulsion precipitation methods are also discussed in Chapters I and II of Mees and James, *The Theory of the Photographic Process,* Third Edition, the MacMillan Company, 1966.

Upon initial introduction into the reaction vessel the dissolved silver salt reacts with dissolved halide salt to form silver halide crystals. This initial phase of silver halide emulsion preparation in which new silver halide crystals are being formed is referred to as nucleation. During subsequent addition of silver salt, additional silver halide formed as a reaction product can be precipitated onto these nuclei causing the mean size of the silver halide grains to increase, ultimately resulting in silver halide grains of the desired mean particle size. Although nucleation and continued silver halide grain growth most commonly occur in a single reaction vessel, it is recognized that nucleation can be undertaken in one reaction vessel, employing single or double jet precipitation techniques, and the resulting fine grained silver halide emulsion fed into a second reaction vessel along with or in advance of additional amounts of halide and silver salts to facilitate continued grain growth. Multiple stage or cascade silver halide precipitation techniques of this type are illustrated by Terwilliger et al, "Precipitation of Silver Halide Emulsions in a Continuous Reaction", Item 14987, *Research Disclosure,* September 1976, and Terwilliger et al U.S. Pat. No. 4,046,576, issued Sept. 6, 1977, here incorporated by reference.

While introducing the aqueous silver salt into the reaction vessel containing the silver halide nuclei a conventional methine spectral sensitizing dye is introduced into the reaction vessel. Where the spectral sensitizing dye is itself soluble, it can be introduced as an aqueous solution without any additional or auxiliary solvent being present. In most instances it is convenient to dissolve the spectral sensitizing dye in an organic water-miscible solvent, such as acetone or an alcohol of from 1 to 3 carbon atoms. Surfactants and/or peptizers can also be present in the spectral sensitizing dye solutions. The spectral sensitizing dye solution can be introduced into the reaction vessel in a separate jet or can be introduced by mixing with the aqueous silver salt and/or the aqueous halide salt being run into the reaction vessel. The spectral sensitizing dye can be introduced into the reaction vessel continuously or can be introduced into the reaction vessel in discrete increments. For example, the introduction of the silver salt and/or the halide salt can be periodically interrupted while the spectral sensitizing dye is introduced. Except as specifically discussed below, techniques similar to those employed by Hill U.S. Pat. No. 2,735,766, cited above and here incorporated by reference, can be employed as well as conventional techniques for introducing spectral sensitizing dyes into performed silver halide emulsions, such as those disclosed in Paragraph XVII., *Product Licensing Index*, Vol. 92, December 1971, publication 9232.

By delaying introduction of the spectral sensitizing dye until silver halide nuclei are present in the reaction vessel interference with nucleation is avoided. Preferably introduction of the spectral sensitizing dye is delayed until the mean diameter of the silver halide nuclei is at least about 0.01 (most preferably 0.05) of the mean diameter of the silver halide grains in the finished emulsion. In the most common instance, that is, where the reaction vessel is initially free of silver halide nuclei at the beginning of the silver salt run, adequate nucleation in the absence of dye is achieved by delaying dye introduction until at least about 1 percent of the silver salt has been run into the reaction vessel, preferably about 2 percent, optimally at least about 5 percent. (Although spectral sensitizing dye addition is referenced to silver salt addition, it can alternatively be referred to halide salt addition and the same numerical limits applied.) Where silver halide nuclei are separately formed and introduced into the reaction vessel, spectral sensitizing dye introduction into the reaction vessel can be commenced concurrently with or even slightly in advance of silver and/or halide salt introduction.

Introduction of the spectral sensitizing dye into the reaction vessel after silver halide nuclei are present can continue throughout silver halide precipitation and can extend beyond silver halide precipitation. The spectral sensitizing dye is introduced into the reaction vessel in a spectral sensitizing amount before at least about 85 percent of the silver salt has been run into the reaction vessel, peferably before 80 percent of the silver salt has been introduced and most preferably before 75 percent of the silver salt has been introduced. Where no silver halide nuclei are present in the reaction vessel at the commencement of the silver salt run, introduction of the spectral sensitizing dye is advantageous when from 1 to 85 percent, preferably 2 to 80, and most preferably 5 to 75 percent of the silver salt has been introduced.

For best results, after an appropriate delay to permit nucleation (quantitatively referenced to the silver halide nuclei diameters or the 1, 2 and 5 percent silver salt introduction levels, identified above), the spectral sensitizing dye is incrementally or continuously added to the reaction vessel over the course of silver salt introduction thereto and is preferably completed before silver salt introduction to the reaction vessel is completed (quantitatively referenced to the 85, 80 and 75 percent silver salt introduction levels identified above). The rate of continuous dye introduction can be maintained constant or can be accelerated to reflect the increasing surface area of the silver halide grains being formed. Where the dye is added in discrete increments, the increments of dye addition are preferably selected to approximate continuous dye introduction over the selected interval of silver salt introduction. Where introduction of the spectral sensitizing dye is delayed until after larger proportions of the silver salt have been introduced into the reaction vessel, larger than about 75 percent of the silver salt, the spectral sensitization achieved begins to approach more closely that observed when the spectral sensitizing dye is run into the reaction vessel after silver precipitation is completed according to conventional techniques.

Where spectral sensitizing dye is run into the reaction vessel during silver salt addition as required above and is additionally run into the reaction vessel during the latter stages of silver salt addition—that is, after at least about 75 percent of the silver salt has been introduced—and/or added to the silver halide emulsion by conventional techniques after silver halide precipitation is complete, a further unexpected improvement in spectral sensitization can be obtained. Thus, further spectral sensitization by conventional techniques and/or toward the end of the silver salt run in combination with spectral sensitization according to the preferred embodiments of this method as described above is specifically contemplated and recognized to be advantageous. Any conventional spectral sensitizing dye which will alone improve the spectral response of the emulsion can be employed in combination with the methine spectral sensitizing dyes introduced into the reaction vessel according to the method described above. It is specifically contemplated to use the same methine dyes to spectrally sensitize the emulsions during silver halide precipitation as described above and during the latter stages of silver halide precipitation or after completion of silver halide precipitation.

One or more conventional methine spectral sensitizing dyes can be introduced into the reaction vessel during silver halide precipitation as described. Such dyes are described, for example, in Brooker et al U.S. Pat. No. 2,526,632 issued Oct. 24, 1950; Sprague U.S. Pat. No. 2,503,776 issued Apr. 11, 1950; Brooker et al U.S. Pat. No. 2,493,748 issued Jan. 10, 1950; and Taber et al U.S. Pat. No. 3,384,486 issued May 21, 1968. Spectral sensitizers which can be used include the cyanines, merocyanines, complex (tri- or tetra-nuclear) cyanines, holopolar cyanines, styryls, hemicyanines (e.g. enamine hemicyanines), oxonols and hemioxonols.

Dyes of the cyanine classes suitable for sensitizing silver halide can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl and enamine groups and can be fused to carbocyclic or heterocyclic ring systems either unsubstituted or substituted with halogen, phenyl, alkyl, haloalkyl, cyano, or alkoxy groups. The dyes can be symmetrical or unsymmetrical and can contain alkyl, phenyl, enamine or heterocyclic substituents on the methine or polymethine chain.

The merocyanine dyes can contain the basic nuclei mentioned above as well as acid nuclei such as thiohydantoins, rhodanines, oxazolidenediones, thiazolidenediones, barbituric acids, thiazolineones, and malononitrile. These acid nuclei can be appropriately substituted with alkyl, alkylene, phenyl, carboxylalkyl, sulfoalkyl, hydroxyalkyl, alkoxyalkyl, alkylamino groups, or heterocyclic nuclei. Combinations of these dyes can be used, if desired. In addition, supersensitizing addenda which do not absorb visible light can be included, for instance, ascorbic acid derivatives, azaindenes, cadmium salts, and organic sulfonic acids as described in McFall et al U.S. Pat. No. 2,933,390 issued Apr. 19, 1960; and Jones et al U.S. Pat. No. 2,937,089 issued May 17, 1960.

The methine dyes employed in the practice of this invention are in one preferred form imidazole, oxazole and thiazole methine spectral sensitizing dyes. That is, they are conventional methine spectral sensitizing dyes containing at least one imidazole, oxazole or thiazole nucleus. In a specifically preferred form, the spectral sensitizing dyes are cyanine dyes in which at least two nuclei of the dye are chosen from imidazole, oxazole and thiazole nuclei. Specifically preferred are cyanine dyes in which both of the nuclei are imidazole, oxazole or thiazole nuclei, such as those represented by the formula:

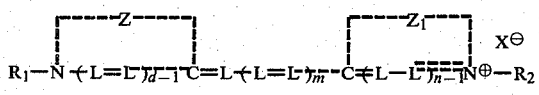

wherein d and n each represents a positive integer of from 1 to 2, m represents a positive integer of from 1 to 3, L represents a methine group (e.g., —CH= and —C(CH$_3$)=), $R_1$ and $R_2$ each represents an alkyl group, preferably a lower alkyl containing from one to four carbon atoms, (e.g., methyl, ethyl, propyl, isopropyl, butyl, hexyl, decyl or dodecyl), a substituted alkyl group, preferably a substituted lower alkyl group containing one to four carbon atoms, such as a hydroxyalkyl group (e.g., β-hydroxyethyl, γ-hydroxypropyl or ω-hydroxybutyl), an alkoxyalkyl group (e.g., β-methoxyethyl or β-butoxybutyl), a carboxyalkyl group (e.g., β-carboxyethyl or ω-carboxybutyl), a sulfoalkyl group (e.g., β-sulfatoethyl or ω-sulfatobutyl), an acyloxyalkyl group (e.g., β-acetoxyethyl or ω-propionyloxybutyl), an alkoxycarbonylalkyl group (e.g., β-methoxycarbonyethyl or ω-ethoxycarbonylbutyl), an allyl group, an aralkyl group (e.g., benzyl or phenethyl) or an aryl group (e.g., phenyl, tolyl, chlorophenyl, sulfophenyl or carboxyphenyl), and Z and $Z_1$ each represents an imidazole nucleus (e.g., imidazole, alkyl imidazoles, 1-aryl imidazoles, benzimidazole, 1-alkyl benzimidazoles, 1-aryl benzimidazoles, 5-chloro-1-alkyl benzimidazoles, 5-chloro-1-aryl benzimidazoles, 5,6-dichloro-1-alkyl benzimidazoles, 5,6-dichloro-1-aryl benzimidazoles, 5-methoxy-1-alkyl benzimidazoles, 5-methoxy-1-aryl benzimidazoles, 5-cyano-1-alkyl benzimidazoles, 5-cyano-1-aryl benzimidazoles, naphth[1,2-d]imidazole, 1-alkylnaphth[1,2-d]imidazoles or 1-arylnaphth[1,2-d]imidazoles), an oxazole nucleus (e.g., oxazole, 4-alkyl oxazoles, 4,5-dialkyl oxazoles, 4-aryl oxazoles, 4,5-diaryl oxazoles, 4-nitrooxazole, benzoxazole, 5-chlorobenzoxazole, 5- or 6-nitrobenzoxazole, 5-arylbenzooxazole, 5- or 6-alkoxy benzoxazole, 5- or 6-hydroxy benzooxazole, naphtho[1,2-d]oxazole or nitro-substituted naphth[1,2-d[oxazoles) or a thiazole nucleus (e.g., thiazole, 4-alkyl thiazoles, 2-thienyl thiazoles, 4-aryl thiazoles, 4,5-diaryl thiazoles, benzothiazole, 5- or 6-chloro or bromobenzothiazoles, 4-alkyl benzothiazoles, 5- or 6-alkoxy benzothiazoles or 4-aryl benzothiazoles).

It will be noted that in some instances, the acid anion, represented by X in the above formula, is included in the substituent represented by $R_2$, such as in dyes containing the betaine type structure. In the nuclei substituents referred to above the alkyl moieties preferably contain from 1 to 4 carbon atoms and the aryl substituents contain from 6 to 10 carbon atoms, e.g., phenyl and naphthyl. Imidazole, oxazole and thiazole cyanine spectral sensitizing dyes are well known in the art and are disclosed, for example, by A. H. Herz, *Photographic Science and Engineering, Vol.* 18, No. 2, March–April 1974, pages 207 through 215; VanLare, U.S. Pat. No. 3,482,981, issued Dec. 9, 1962; and in numerous other patents and publications.

Illustrative of preferred merocyanine spectral sensitizing dyes are those disclosed by Hill U.S. Pat. No. 2,735,766.

By employing a single jet or double jet precipitation technique as described above modified by the introduction of a methine spectral sensitizing dye into the reaction vessel after silver halide nucleation has commenced and before completion of the silver salt run, a silver halide emulsion can be prepared having unique properties. Such an emulsion when coated onto a conventional photographic film or paper support to form a photographic element exhibits a unique spectral response which distinguishes it from otherwise identically formed photographic elements in which the spectral sensitizing dye is added to the emulsion after completion of the silver halide precipitation. Additional preferred and unexpected characteristics can be imparted to the photographic silver halide emulsions and elements by employing in combination materials and procedures more specifically discussed below.

Although additional silver halide grain formation (additional mucleation) can occur after introduction of spectral sensitizing dye into the reaction vessel, it is preferred that nucleation of silver halide grains (formation of new grains) be substantially complete before spectral sensitizing dye is run into the reaction vessel. One technique which has been found particularly useful for shortening silver halide precipitation times while insuring that additional silver halide precipitates onto existing silver halide grain nuclei is either stepwise or gradually to increase the rates of halide and silver salt additions. Such techniques are well known in the art are disclosed, for example, by Kurz U.S. Pat. No. 3,672,900, issued June 27, 1972. Kurz teaches increasing the rates of silver and halide salt introductions according to the formula:

$$at^2+bt+c$$

wherein t equals time of precipitation and a, b and c are constants dependent on factors such as, for example, temperature, concentration, metal ion concentration and the like, and wherein the constants can be derived theoretically or preferably are derived empirically for the particular conditions of operation. The constants are preferably determined for a value wherein new nuclei will not form after initial precipitation whereby all grains will generally grow at the same rate to produce a substantially monodispersed emulsion.

The reaction vessels as well as the apparatus and techniques for associating the aqueous silver and halide salt solutions and handling the silver halide emulsion which is formed as a reaction product can be of any convenient conventional type. Such apparatus and techniques are illustrated by Hill, Philippaerts, and *Product*

*Licensing Index* publication 9232, paragraph XVII, each cited above. Such techniques and apparatus are further illustrated by Culhane et al U.S. Pat. No. 3,821,002; British Pat. No. 1,302,405; Irie et al U.S. Pat. No. 3,650,757; Audran U.S. Pat. No. 2,996,382; British Pat. No. 846,190; Frame et al U.S. Pat. No. 3,415,650; Porter et al U.S. Pat. No. 3,785,777; Porter et al U.S. Pat. No. 3,782,954; West German OLS No. 2,555,364; West German OLS No. 2,555,885; Posse et al U.S. Pat. No. 3,790,386; and Forster et al U.S. Pat. No. 3,897,935.

Photographic compositions and elements including silver halide grains spectrally sensitized as described above can include a number of compatible, conventional features not specifically described. Such conventional aspects of the composition and element types and processes for their preparation and use are disclosed in *Product Licensing Index,* Vol. 92, December 1971, item 9232, and *Research Disclosure,* Vol. 176, December 1978, Item 17643, here incorporated by reference. The prefixes PLI and RD are hereinafter employed to designate paragraphs of the above-identified publications. The silver halide emulsions can be either unwashed or washed as disclosed by PLI and RD paragraphs II. Emulsion washing. The emulsions can be chemically sensitized as disclosed by PLI and RD paragraphs III. Chemical sensitizing. The emulsions can contain development modifiers, antifoggants and stabilizers, developing agents and hardeners, as disclosed in PLI paragraphs IV through VII and RD paragraphs VI, X, XX and XXI. Any of the conventional vehicles for the emulsions disclosed in PLI paragraph VIII and RD paragraph IX can be employed. The emulsions and other element layers can be coated on photographic supports as disclosed in PLI paragraph X and RD paragraph XVII Supports. Any conventional spectral sensitizing dye can be incorporated into the emulsion in addition to the spectral sensitizing dyes added during silver halide precipitation. Typical conventional dyes are disclosed in PLI paragraph XV and RD paragraph IV Spectral sensitization. These additional spectral sensitizing dyes as well as other addenda can be introduced into the emulsion compositions by the techniques disclosed, for example, in PLI paragraph XVII and RD paragraph XIV Methods of addition. The remaining paragraphs of the referenced *Product Licensing Index* and *Research Disclosure* publications disclose still other photographic features and methods of photographic processing which can be employed in combination with the features of this invention specifically disclosed. Both *Product Licensing Index* and *Research Disclosure* are published by Industrial Opportunities Limited, Homewell, Havant Hampshire, P09 1EF, United Kingdom.

The invention is further illustrated by the following examples:

EXAMPLE 1

Illustrating Spectral Sensitization of a Silver Chloride with a Benzothiazole Merocyanine The following solutions were employed:

| Solution A | |
|---|---|
| Phthalated gelatin | 240 g |
| 1,8-Dihydroxy-3,6-dithiaoctane | 2.1 g |
| 21.9% by weight sodium chloride in water | 246 ml |

-continued

| Solution A | |
|---|---|
| Distilled water | 8400 ml |

| Solution B | |
|---|---|
| Sodium chloride | 520 g |
| Distilled water to total volume of | 3460 ml |

| Solution C | |
|---|---|
| Silver nitrate | 1020 g |
| Distilled water to total volume of | 3460 ml |

| Solution D | | |
|---|---|---|
| Dye I* | 0.78 | g |
| 1:1, volume ratio, acetone to water | 500 | ml |
| Distilled water | 127 | ml |

*Dye I
5-(3-Ethyl-2-benzothiazolidinylidene)-3-β-sulfoethylrhodanine

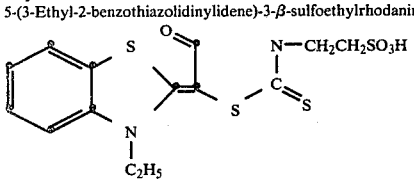

Solution A was placed in a reaction vessel equipped with a mechanical agitator and adjusted to a pH of 5.6 and pAg of 6.7 at 60° C. While agitating Solution A, Solutions B and C were separately introduced into the reaction vessel in separate jets at a uniform rate over a period of 40 minutes while maintaining the pAg of the composition within the reaction vessel at 6.7. Two minutes after starting the introduction of Solutions B and C, Solution D was introduced into the reaction vessel in a separate jet at a uniform rate, and the addition of Solution D was halted two minutes prior to the end of the addition of Solutions B and C.

The emulsion produced was coagulated by lowering the pH and the supernatant liquid was decanted. After decanting the supernatant liquid, the coagulum was redispersed in water. This procedure was repeated twice. The final coagulum was dispersed in water at 40° C./pH 5.6/pAg 7.6.

Electron micrographs showed that the silver halide grains were predominantly octahedral.

The emulsion was chemically sensitized with gold sulfide, combined with a cyan dye-forming coupler, 1-hydroxy-2-[4-(2,4-di-tert-amylphenoxy)-n-butyl]-naphthamide, and coated on a cellulose acetate film support at 1.62 g Ag/m$^2$, 7.0 g gelatin/m$^2$ and 1.78 g coupler/m$^2$.

The dried coating was exposed for 1/25 second to tungsten light which was filtered to provide a 470 nm exposure and processed for 60 seconds/31° C. in the color developer set forth in Table I.

TABLE I

| Color Developer | |
|---|---|
| 4-amino-3-methyl-N-ethyl-N-β-(methanesulfonamido)ethylaniline sulfate hydrate | 4.3 g |
| Potassium bromide | 0.15 g |
| Potassium chloride | 1.0 g |

TABLE I-continued

| Color Developer | |
|---|---|
| Benzyl alcohol | 11.0 g |
| Hydroxylamine sulfate | 3.4 g |
| Potassium carbonate | 31.0 g |
| Potassium bicarbonate | 0.5 g |
| Potassium sulfite | 2.0 g |
| Hydroxyethylcellulose (Natrosol 250L trademark) | 0.06 |
| Water to 1 liter (pH 10.08) | |

The silver chloride emulsion exhibited a mean grain diameter of 0.65 micron. The silver chloride grains were monodispersed and of octahedral grain morphology. The contrast of the emulsion was 2.00, the minimum density 0.10 and the maximum density 2.00. For purposes of comparison with the remaining examples, a relative speed value of 100 was assigned to the emulsion. Speed was measured at 0.30 above minimum density on the characteristic curve. Control was measured over the straight-line mid-portion of the characteristic curve. Density measurements were made after bleaching the silver image using a red filter.

EXAMPLE 2

Illustrating Varied Dye Additions

The procedure of Example 1 was repeated, except that addition of Solutions B and C were halted 30 minutes after the beginning of the precipitation step, and Solution D was then added to the reaction vessel over a period of 5 minutes. After Solution D's addition was complete, Solutions B and C were added to the reaction vessel to complete precipitation of silver halide.

The silver halide emulsion produced was polydispersed with grain diameters falling within the range of from 0.45 to 0.95 micron. The contrast of the emulsion was 2.16, the minimum density 0.10 and the maximum density 2.00. The relative speed, compared to Example 1, was 46.

In a separate run, when the introduction of Solution D was delayed until after Solutions B and C had been run for 35 minutes, the resulting emulsion exhibited comparable minimum and maximum densities, but a somewhat lower speed and contrast.

(COMPARATIVE) EXAMPLE 3

Comparing a Conventional Post-Precipitation Spectrally Sensitized Emulsion

To provide a direct comparison with conventional precipitation techniques, the procedure of Example 1 was repeated, except that Dye I was *not* present during the precipitation step. Dye I was added just prior to coating the emulsion on the support at a coverage of 130 mg/mole Ag.

The emulsion was monodispersed having a mean grain diameter of 0.70 micron. The silver chloride grains were cubic. The contrast was 2.20, the minimum density 0.10 and the maximum density 2.00. The relative speed, compared to Example 1, was 25.

This example, compared with Examples 1 and 2, demonstrates that the method herein disclosed is capable of producing silver halide emulsions of very significantly enhanced speeds and that different grain structure can be obtained as a result of introducing the spectral sensitizing dye after nucleation and during silver halide precipitation.

When Examples 1 and 3 were repeated, but with an exposure of 365 nm being chosen to ascertain the intrinsic speeds of the emulsions outside of the region of spectral sensitization, it was determined that the element produced by Example 1 was 100 percent faster than that produced by Example 3.

When the elements produced by Examples 1 and 3 were separately immersed in an agitated 1:1 (weight ratio) methanol-water solution, it was observed that spectral sensitizing dye entered the solution from the element of Example 3. No spectral sensitizing dye was removed from the element of Example 1. This showed the dye in the Example 1 element to be so tightly held as to be non-wandering. It is not understood exactly how the spectral sensitizing dye added during silver halide precipitation is associated with the silver halide grains, but it appears that the relationship of the dye to the grains produced by this method is demonstratably different than that produced by introducing the spectral sensitizing dye after silver halide precipitation.

(COMPARATIVE) EXAMPLE 4

Illustrating Prenucleation Dye Additions

The concept of introducing the spectral sensitizing dye into the reaction vessel along with one of the silver or halide salts before silver halide nucleation is known in the art, as illustrated by the teachings of Hill and Philippaerts, cited above. When Example 1 was repeated with Dye I incorporated in the aqueous halide salt solution, Solution B, a markedly inferior, polydispersed silver halide emulsion was obtained. The relative speed of the emulsion, compared with Example 1, was only 1. When the procedure was performed again, but with the spectral sensitizing dye combined with the aqueous silver salt solution, Solution C, the liquid in the reaction chamber separated into two separate phases, and the experiment was discontinued.

EXAMPLE 5

Illustrating the Use of Cyanine Spectral Sensitizing Dyes

Example 1 was repeated substituting in each instance one of the dyes listed below for Dye I:

Dye II—Anhydro-5-chloro-9-ethyl-5'-phenyl-3'-(3-sulfobutyl)-3-(3-sulfopropyl)oxacarbocyanine hydroxide, sodium salt

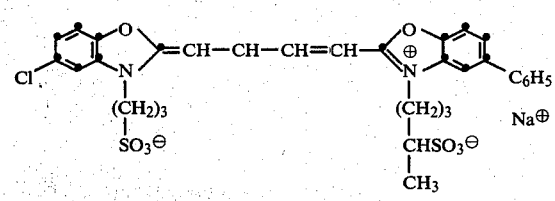

Dye III—Anhydro-5,5',6,6'-tetrachloro-1,1',3-triethyl-3'-(3-sulfobutyl)benzimidazolocarbocyanine hydroxide

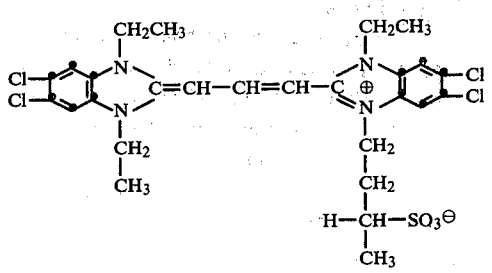

Dye IV—Anhydro-9-ethyl-5',6'-dimethoxy-5-phenyl-3'-(3-sulfobutyl)-3-(3-sulfopropyl)oxathiocarbocyanine hydroxide, sodium salt

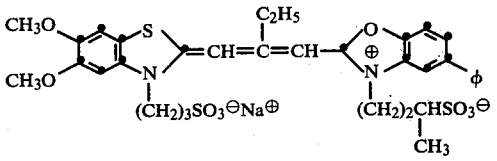

$\phi$ = phenyl

Dye V—Anhydro-3,3'-bis(3-sulfopropyl)-4,5,4',5'-dibenzothiacyanine hydroxide, sodium salt

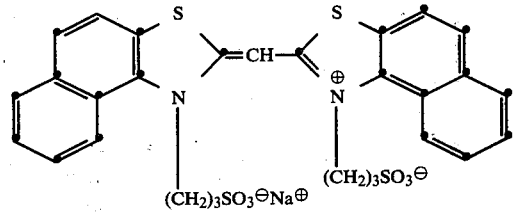

Dye VI—Anhydro-5,5'-dimethoxy-3,3'-bis(3-sulfopropyl)thiacyanine hydroxide, sodium salt

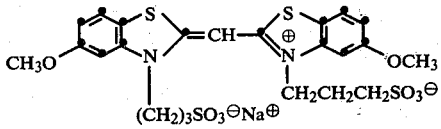

The results obtained were qualitatively similar to those of Example 1, although in some instances an alteration in grain morphology was observed. Whereas Dye I produced monodispersed octahedral silver halide grains, Dye II produced very pronounced cubic grain structures. This suggests that Dye I adsorbs preferentially on 111 crystal surfaces, thereby promoting octahedral grain growth, whereas Dye II adsorbs best on 100 crystal surfaces, thereby enhancing the probability of cubic crystal formation occurring.

EXAMPLE 6

Illustrating the Effect of Combining Spectral Sensitization During the Silver Salt Run with Post-Precipitation Spectral Sensitization Substituting Dye II for Dye I, Example 3 was repeated using two different dye concentrations set out below in Table II, and Example 1 was repeated using 250 mg of Dye II per mole of silver, as set out in Table II. In a fourth run Example 1 was repeated using 200 mg of Dye II per mole of silver and Dye II was also added to the emulsion just prior to coating to bring the total Dye II concentration to 450 mg per mole of silver. The relative speeds are set out in Table II.

TABLE II

Relative Speed Comparison

| Example | Total mg Dye II/mole Ag | Relative Speed | Comments |
|---|---|---|---|
| Comparative | 250 | 100 | Post-precipitation Spectral Sensitization |
| Like Example 5 | 250 | 389 | Post-nucleation Spectral Sensitization |
| Comparative | 450 | 363 | Post-precipitation Spectral Sensitization |
| Example 6 | 450 | 661 | Post-nucleation plus Post-precipitation Spectral Sensitization |

The relative speeds show a distinct advantage for post-nucleation spectral sensitization as compared to post-precipitation spectral sensitization. Additionally, where post-nucleation and post-precipitation spectral sensitization are combined, the improvement in relative speeds is unexpectedly enhanced.

EXAMPLE 7

Illustrating Spectral Sensitization of Silver Bromoiodide

The following solutions were employed:

| Solution A | | |
|---|---|---|
| Phthalated gelatin | 116 | g |
| KBr | 609 | g |
| KI | 4.4 | g |
| Distilled water | 4943 | ml |

| Solution B | | |
|---|---|---|
| KI | 46.6 | g |
| Distilled $H_2O$ to total volume | 2070 | ml |

| Solution C | | |
|---|---|---|
| $AgNO_3$ | 822 | g |
| $HgCl_2$ | .13 | mg |
| Distilled $H_2O$ to total volume | 9300 | ml |

| Solution D | | |
|---|---|---|
| Dye VI | 1.1 | g |
| Distilled $H_2O$ to total volume | 639 | ml |

Step 1: Solution A was placed in a reaction vessel and adjusted to a temperature of 80° C.

Step 2: Solution B and C were run into Solution A (with agitation) such that the B solution was completely added in 20 minutes and the C solution was completely added in 40 minutes. Two minutes after starting the flow of Solutions B and C, Solution D was added to A. The addition of D was completed in 35 minutes.

Step 3: One minute after the completion of the addition of Solution C, temperature of the solution was lowered to 50° C, 60 grams of sodium thiocyanate were added to the solution, and the resulting mixture was stirred for 25 minutes.

Step 4: The emulsion was coagulated by lowering the pH and the supernatant liquid was decanted. The coagulum was then redispersed in water. To the redispersed solution, 5.6 grams of KBr were added and the solution was stirred for 3 minutes at 30° C. The coagulation procedure was then repeated two more times. The final coagulum was dispersed in water at 40° C./pH 6.5/pAg 8.0.

Photomicrographs of this emulsion showed that the emulsion grains ranged in size from less than 0.2 μm in diameter to greater than 3.0 μm in diameter.

For purposes of comparison a control emulsion was prepared as described above, except that the dye was added to the emulsion just prior to coating. Photomicrographs indicated that this emulsion was in the size range of 0.3 to 3.5 microns in grain diameter with most of the grains being in the range of 0.5 to 0.7 micron. This latter size class contributed markedly to light scatter and was not nearly as prevalent in the emulsion formed above by dye addition after nucleation.

Both of the above emulsions were gold and sulfur sensitized and coated in a color photographic format on a cellulose acetate film support at 1.62 g Ag/m$^2$ and 7.0 g gelatin/m$^2$. These elements were exposed to a tungsten light source for 1/25 second, color processed in a color developer containing p-phenylenediamine as a developing agent at 27° C. and a pH of 10, and compared sensitometrically. It was found that the post-precipitation spectrally sensitized control element had a higher contrast than the post-nucleation spectrally sensitized element prepared according to this process, but that both elements had identical threshold sensitivities. Turbidity of the control emulsion was higher than for the emulsion according to this process. This result indicated an improved speed/sharpness characteristic for the element prepared according to this method.

EXAMPLE 8

Illustrating Spectral Sensitization of Silver Chlorobromide

| Solution A | |
|---|---|
| Phthalated gelatin | 240 g |
| 21.9% solution of NaCl/$H_2O$ | 260 ml |
| 4.4% solution of KBr/$H_2O$ | 147 ml |
| Distilled water | 8400 ml |

| Solution B | | |
|---|---|---|
| NaCl | 489 | g |
| NaBr | 51.7 | g |
| Distilled water to total volume | 3380 | ml |
| Temperature | | 50°C. |

| Solution C | |
|---|---|
| $AgNO_3$ | 1020 g |
| Distilled water to total volume | 3380 ml |
| Temperature | 50°C. |

| Solution D | | |
|---|---|---|
| Dye I | 0.78 | g |
| 1:1 methanol $H_2O$ | 500 | ml |
| Distilled water | 127 | ml |
| Temperature | | 50°C. |

Step 1: Solution A was adjusted to 80° C./pH 5.55/vAg 89 mv.

Step 2: Solutions B and C were added simultaneously to Solution A with agitation over a period of 90 minutes. Ten minutes after Solutions B and C were started, Solution D was added to Solution A over a period of 34 minutes.

Step 3: The emulsion was cooled to 33° C. and coagulated by lowering the pH to 3.90. The supernatant was decanted and the coagulum was redispersed in water at pH 6.0/40° C. This procedure was repeated and the emulsion was redispersed at pH 5.6/pAg 7.6 after adding a solution of distilled water (600 ml) and bone gelatin (120 g).

Electron micrographs shows a polydispersed, 0.75 μm–1.25 μm, cubo-octahedral emulsion. The emulsion was chemically sensitized, combined with a coupler, coated exposed and processed as described for Example 1. This emulsion had a relative speed of 25 in comparison to Example 1.

EXAMPLE 9

Illustrating Incremental Dye Addition During Silver Iodide Precipitation

The following solutions were prepared:

| Solution A | |
|---|---|
| Gelatin | 17.5 g |
| Water | 1.5 l |
| Temperature | 35° C. |
| pH | 6.0 |

| Solution B |
|---|
| 200 ml of a 2.5 molar aqueous solution of Sodium iodide |

| Solution C |
|---|
| 200 ml of a 2.5 molar solution of silver nitrate |

| Solution D* |
|---|
| 170 ml containing 606 mg Dye-VII anhydro-5,5',6,6'-tetrachloro-1,1'-diethyl-3,3'-di(3-thiosulfatopropyl)benzimidazolocarbocyanine hydroxide, tetramethylguanidinium salt. |

*Dye VII was dissolved in phenoxyethanol (trademark Dowanol), acidified and then diluted to 170 ml total volume with methanol.

Solution A was placed in a reaction vessel and adjusted to a pAg of 6.45 with Solution B. Solutions B and C were then added simultaneously at an accelerated flow rate (1 ml/minute initial flow rate, 9 ml/min final flow rate) to the reaction vessel containing Solution A over a period of 50 minutes. At the time intervals indicated below the introduction of Solutions B and C were interrupted and the indicated amounts of Solution D were added:

| | | | | |
|---|---|---|---|---|
| Time (min) | 5 | 11 | 18 | 22.2 |
| ml Solution D | 3.9 | 7.25 | 11.1 | 15.6 |
| Time (min) | 28.2 | 34.2 | 39.2 | 44.3 |
| ml Solution D | 21.15 | 27.3 | 32.6 | 37.5 |

After each dye addition, the emulsion was adjusted to pH 7.5, held for 2 minutes, readjusted to pH 6.0 and then precipitation was resumed by introducing Solutions B and C once again. At the completion of the run the pAg of the emulsion was adjusted with an additional quantity of Solution C. At the completion of the run the emulsion contained 1.1 grams of Dye VII per mole of silver. The excess soluble salts were removed from the emulsion with an ion exchange resin by the procedure described in Maley U.S. Pat. No. 3,782,953. The emulsion was adjusted to 4.5 kg/mole silver, pH of 3.0 and a pAg of 2.0.

Generally similar emulsion making procedures were employed to prepare emulsions each containing one of the following dyes:

Dye VIII—anhydro-9-methyl-3,3'-di(3-sulfobutyl)benzothiazolocarbocyanine triethylamine, sodium salt Dye IX—5,5',6,6'-tetrachloro-1,1',3,3'-tetraethylbenzimidazolocarbocyanine p-toluene sulfonate Dye X—3,3'-diethyl-5,5'-diphenylbenzoxazolocarbocyanine iodide.

The emulsions were coated on transparent photographic film supports at coverages of 8.07 mg silver per square decimeter and 97.9 mg gelatin per square decimeter. Coating melts contained saponin and 2-methyl-2,4-pentanediol as a spreading agent and humectant, respectively. The emulsion was adjusted to a pH of 4 and a pAg of 6 at 35° C. prior to coating. Samples of the photographic elements were exposed using wedge spectrographs and developed for 10 minutes at room temperature in Kodak D-19 developer containing 1 gram of poly(ethylene oxide) and fixed using Kodak F5 fix solution. Corresponding controls were prepared, exposed and processed which in each instance varied only in that the dye was added to the emulsion after silver halide precipitation was completed in accordance with conventional practice.

The photographic elements prepared according to the method of this invention using Dye VII showed a stronger absorption band at 545 nm at a coating pAg of 6.5 and a red-shift J-band was observed when the element was coated at a pAg of 10.5. Dye VIII showed a bathochromic adsorption shift as compared to the control and J-banding which was absent from the control. With Dye IX a large enhancement in maximum densities were obtained throughout the visible spectrum as well as an enhancement in J-banding. With Dye X an enhancement of blue sensitivity was obtained. Although variations in response attributable to running the dye into the reaction vessel during silver halide precipitation appeard to be a function of the particular dye chosen, in each instance it was apparent that the emulsion prepared according to the process of this invention differed in its properties from the control emulsion.

The invention has been described with reference to particular preferred embodiments thereof but it will be understood that variations and modifications can be effected within the spirit and scope of the invention.

We claim:

1. In a method of preparing a spectrally sensitized radiation-sensitive silver halide emulsion comprising introducing into a reaction vessel an aqueous solution of a silver salt, an aqueous solution of a halide salt, a peptizer and a methine spectral sensitizing dye, the dye being added to the reaction vessel during the course of introducing at least one of the aqueous salt solutions, the improvement comprising delaying addition of the spectral sensitizing dye until silver halide grain nuclei are present in the reaction vessel having a mean diameter which is at least 0.01 of the mean diameter of the silver halide grains of the radiation-sensitive silver halide emulsion to be prepared.

2. In a method according to claim 1 the further improvement in which the halide salt is a chloride salt.

3. In a method according to claim 1 the further improvement in which the halide salt is a bromide salt.

4. In a method according to claim 1 the further improvement in which the halide salt is an iodide salt.

5. In a method according to claim 1 the further improvement in which the methine dye is a merocyanine dye.

6. In a method according to claim 1 the further improvement in which the methine dye is a cyanine dye.

7. In a method according to claim 6 the further improvement in which the cyanine dye contains a benzothiazole, benzimidazole or benzoxazole nucleus.

8. In a method according to claim 1 the further improvement in which introduction of the spectral sensitizing dye into the reaction vessel is delayed until the silver halide grain nuclei have a mean diameter which is at least 0.05 of the mean diameter of the silver halide grains of the radiation-sensitive silver halide emulsion to be prepared.

9. In a method according to claim 1 the further improvement in which a spectral sensitizing amount of the dye is added to the reaction vessel before 75 percent by weight of the silver salt solution has been introduced.

10. In a method according to claim 1 the further improvement in which additional spectral sensitizing dye is added to the emulsion following silver halide precipitation.

11. In a method of preparing a spectrally sensitized radiation-sensitive silver halide emulsion comprising introducing into a reaction vessel an aqueous solution of a silver salt, an aqueous solution of a halide salt, a peptizer and a methine spectral sensitizing dye, the dye being added to the reaction vessel during the course of introducing at least one of the aqueous salt solutions, the improvement comprising delaying addition of the spectral sensitizing dye until silver halide grain nuclei are present in the reaction vessel having a mean diameter which is at least 0.01 of the mean diameter of the silver halide grains of the radiation-sensitive silver halide emulsion to be prepared, a spectral sensitizing amount of the dye being added to the reaction vessel before 85 percent by weight of the silver salt solution has been introduced.

12. In a method of preparing a spectrally sensitized radiation-sensitive gelatino-silver chloride emulsion comprising introducing into a reaction vessel an aqueous solution of a silver salt, an aqueous solution of a chloride salt, a gelatin peptizer and a cyanine or merocyanine spectral sensitizing dye, the dye being added to the reaction vessel during the course of introducing at least the silver salt solution, the improvement comprising delaying introduction of the spectral sensitizing dye into the reaction vessel until at least 1 percent by weight of the silver salt solution has been introduced.

13. In a method according to claim 12 the further improvement in which introduction of the spectral sensitizing dye into the reaction vessel is delayed until at least 2 percent by weight of the silver salt solution has been introduced and introduction of the spectral sensitizing dye is completed before 80 percent by weight of the silver salt solution has been introduced.

14. In a method according to claim 12 the further improvement in which introduction of the spectral sensitizing dye into the reaction vessel is delayed until at least 5 percent by weight of the silver salt solution has been introduced and introduction of the spectral sensitizing dye is completed before 75 percent by weight of the silver salt solution has been introduced.

15. In a method according to claim 12, in which at least a portion of the silver salt solution and the chloride salt solution are concurrently added to the reaction vessel.

16. In a method of preparing a spectrally sensitized radiation-sensitive gelatino-silver bromoiodide emulsion comprising introducing into a reaction vessel an aqueous solution of a silver salt, an iodide salt and a bromide salt contained in one or more aqueous solutions, a gelatin peptizer and a cyanine spectral sensitizing dye, the dye being added to the reaction vessel during the course of introducing at least the silver salt solution, the improvement comprising delaying introduction of the spectral sensitizing dye into the reaction vessel until at least 2 percent by weight of the silver salt solution has been introduced and completing introduction of the spectral sensitizing dye before 80 percent by weight of the silver salt solution has been introduced.

17. In a method according to claim 16 the further improvement in which spectral sensitizing dye is added in increments during interruptions in silver salt introduction.

18. In a method according to claim 16 the further improvement in which the silver salt solutions and the bromide and iodide salt solutions are introduced into the reaction vessel at an accelerating rate.

19. In a method of preparing a spectrally sensitized radiation-sensitive gelatino-silver iodide emulsion comprising introducing into a reaction vessel an aqueous solution of a silver salt, an aqueous solution of an iodide salt, a gelatin peptizer and a cyanine spectral sensitizing dye, the dye being added to the reaction vessel during the course of introducing at least the silver salt solution, the improvement comprising delaying introduction of the spectral sensitizing dye into the reaction vessel until at least 2 percent by weight of the silver salt solution has been introduced and completing introduction of the spectral sensitizing dye before 80 percent by weight of the silver salt solution has been introduced.

* * * * *